US009926783B2

(12) United States Patent
Lembcke et al.

(10) Patent No.: US 9,926,783 B2
(45) Date of Patent: Mar. 27, 2018

(54) APPARATUS AND METHODS FOR CEMENTED MULTI-ZONE COMPLETIONS

(71) Applicant: Weatherford Technology Holdings, LLC, Houston, TX (US)

(72) Inventors: Jeffrey John Lembcke, Cypress, TX (US); Charles D. Parker, Sugar Land, TX (US); Jason Scott Kiddy, Gambrills, MD (US); Iain Greenan, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 461 days.

(21) Appl. No.: 13/936,856

(22) Filed: Jul. 8, 2013

(65) Prior Publication Data

US 2015/0007977 A1 Jan. 8, 2015

(51) Int. Cl.

| | |
|---|---|
| ***E21C 47/04*** | (2006.01) |
| ***E21C 47/00*** | (2006.01) |
| ***E21B 47/00*** | (2012.01) |

(52) U.S. Cl.

CPC ..... *E21C 47/04* (2013.01); *E21B 47/00* (2013.01); *E21C 47/00* (2013.01)

(58) Field of Classification Search

CPC ..... E21B 47/12; E21B 47/00; E21B 43/00; E21B 17/028; E21B 33/13; E21B 34/06; E21B 43/14; E21B 43/16; E21B 43/25

USPC ..... 166/73, 324

See application file for complete search history.

(56) References Cited

U.S. PATENT DOCUMENTS

| | | | | |
|---|---|---|---|---|
| 5,730,219 | A * | 3/1998 | Tubel | E21B 47/10 166/113 |
| 5,829,520 | A * | 11/1998 | Johnson | E21B 43/086 166/250.01 |
| 6,279,392 | B1 | 8/2001 | Shahin, Jr. et al. | |
| 6,281,489 | B1 * | 8/2001 | Tubel | E21B 47/00 166/250.15 |
| 7,036,601 | B2 | 5/2006 | Berg et al. | |
| 7,159,653 | B2 * | 1/2007 | Vold | E21B 17/025 138/114 |
| 2004/0045351 | A1 * | 3/2004 | Skinner | E21B 47/0006 73/152.48 |
| 2009/0078427 | A1 | 3/2009 | Patel | |

OTHER PUBLICATIONS

Downhole Sensing Cable, accessed on Apr. 15, 2016 via https://www.aflglobal.com/Products/Fiber-Optic-Cable/Downhole.aspx.*

International Search Report and Written Opinion dated Mar. 27, 2015 for Applicant No. PCT/US2014/045429.

Canadian Office Action dated Nov. 25, 2016 for Application No. 2,917,550.

* cited by examiner

*Primary Examiner* — David J Bagnell
*Assistant Examiner* — Manuel C Portocarrero
(74) *Attorney, Agent, or Firm* — Patterson & Sheridan, L.L.P.

(57) ABSTRACT

A method and apparatus for determining a parameter of a production fluid in a wellbore by providing an initially blocked isolated communication path between a sensor and an aperture formed in a sleeve. The isolated communication path is subsequently unblocked to allow measurements of the parameter of the production fluid.

27 Claims, 7 Drawing Sheets

APPARATUS AND METHODS FOR CEMENTED MULTI-ZONE COMPLETIONS

BACKGROUND OF THE INVENTION

Field of the Invention

Embodiments of the present invention generally relate to apparatus and methods for determining parameters of a fluid in a wellbore and, more specifically, an apparatus and method for determining parameters in cemented multi-zone completions.

Description of the Related Art

In the hydrocarbon industry, there is considerable value associated with the ability to monitor the flow of hydrocarbon products in every zone of a production tube of a well in real time. For example, downhole parameters that may be important in producing from, or injecting into, subsurface reservoirs include pressure, temperature, porosity, permeability, density, mineral content, electrical conductivity, and bed thickness. Downhole parameters may be measured by a variety of sensing systems including acoustic, electrical, magnetic, electro-magnetic, strain, nuclear, and optical based devices. These sensing systems are intended for use between the zonal isolation areas of the production tubing in order to measure fluid parameters adjacent fracking ports. Fracking ports are apertures in a fracking sleeve portion of a production tube string that open and close to permit or restrict fluid flow into and out of the production tube.

One challenge of monitoring the flow of hydrocarbon products arises where cement is used for the zonal isolation. In these instances, the annular area between the production tubing and the wellbore is filled with cement and then perforated by a fracking fluid. As a result, sensors located on an exterior surface of the tubing may not be in direct fluid communication with the fluid flowing into and out of the perforated cement locations. Another challenge arises where the sensor spacing is not customized to align with the zonal isolation areas for each drilling operation. For example, the sensing system may include an array of sensors interconnected by a sensing cable. The length of the sensing cable between any two sensors is set and not adjustable. Conversely, the distance between each zonal isolation area varies for each drilling operation. As a result, the sensing system's measurements may be inaccurate due to the sensor's location along the production tube.

What is needed are apparatus and methods for improving the use of sensing systems with cemented zonal isolations.

SUMMARY OF THE INVENTION

The present invention generally relates to a method for determining a parameter of a production fluid in a wellbore. First, a plurality of sensors is attached to a string of tubing equipped with a plurality of sleeves. An isolated communication path is then provided for fluid communication between the plurality of sensors and a plurality of apertures formed in the sleeves. The apertures are initially closed. Next, the string of tubing is inserted and cemented in the wellbore. The apertures in the sleeves are subsequently remotely opened and a fracking fluid is injected into a formation adjacent the wellbore via the apertures, thereby creating perforations in the cement. In one embodiment, the isolated communication path is initially blocked and then, after fracking the path is unblocked, and the parameter of the production fluid adjacent the apertures is measured.

The present invention also relates to a tool string for determining a parameter of a production fluid in a wellbore having a tubing equipped with a sleeve, wherein at least one aperture is formed in the sleeve. The tool string contains a sensor on a sensing cable, wherein the sensor is spaced from the at least one aperture, and a sensor container, wherein the sensor is at least partially enclosed in the sensor container. The tool string includes an isolated communication path that spans a predetermined distance from the sensor container to the nearest aperture, wherein the isolated communication path includes a removable seal.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention is a method and apparatus for sensing parameters in cemented multi-zone completions.

Figure 1:
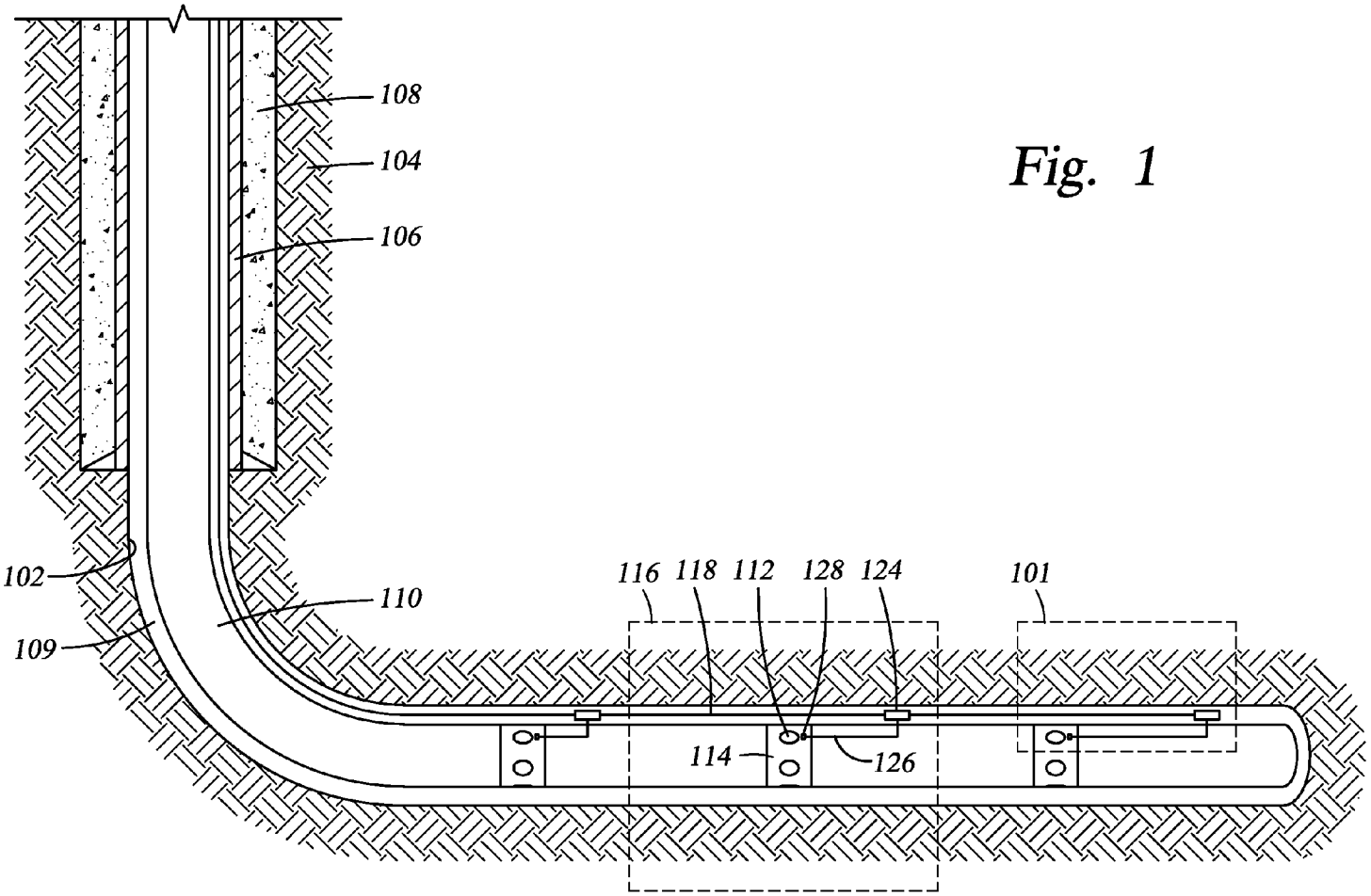
FIG. 1 illustrates a string of production tubing coupled with a string of sensing systems, according to one embodiment of the present invention.

FIG. 1 shows a string of production tubing 110 coupled with a string of sensing systems 101, configured to implement one or more aspects of the present invention. As shown, a wellbore 102 includes a casing 106, cement 108, the production tubing 110 with a plurality of fracking sleeves 114, and the sensing systems 101. Each sensing system 101 includes a sensing cable 118, a sensor 124, and a communication path 126 between the sensor 124 and a location adjacent the fracking sleeve 114.

As shown, the wellbore 102 is lined with one or more strings of casing 106 to a predetermined depth. The casing 106 is strengthened by cement 108 injected between the casing 106 and the wellbore 102. The production tubing 110 extends into a horizontal portion in the wellbore 102, thereby creating an annulus 109. The string of production tubing 110 includes at least one fracking zone 116. Each fracking zone 116 includes production tubing 110 equipped with a fracking sleeve 114. The fracking sleeve 114 includes a plurality of apertures that can be remotely opened or closed during the various phases of hydrocarbon production. In one example, the apertures are fracking ports 112 that remain closed during the injection of cement 108 and are later opened to permit the injection of fracking fluid into a formation 104.

The sensing systems 101 may be interconnected by the sensing cable 118. The sensing cable 118 runs along the outer diameter of the production tubing 110 in the annulus 109. In one example, the sensing cable 118 may be fed from a spool and attached to the production tubing 110 as the strings of the production tubing 110 are inserted into the wellbore 102. The sensing cable 118 contains sensors 124, which may include any of the various types of acoustic and/or pressure sensors known to those skilled in the art. In one example, the sensing system 101 may rely on fiber optic based seismic sensing where the sensors 124 include fiber optic-based sensors, such as fiber Bragg gratings in disclosed in U.S. Pat. No. 7,036,601 which is incorporated herein in its entirety. To determine fluid parameters at the fracking port 112, the sensor 124 is coupled to the communication path 126. The communication path 126 provides fluid communication between the sensor 124 and a fracking port 112. In one example, the communication path 126 may be placed either adjacent the fracturing port 112 or a close distance from the fracking port 112. The communication path 126 may be initially sealed. In one example, a removable plug 128 prevents fluids, up to some threshold pressure, from reaching the sensor 124 through the communication path 126.

Figure 2:
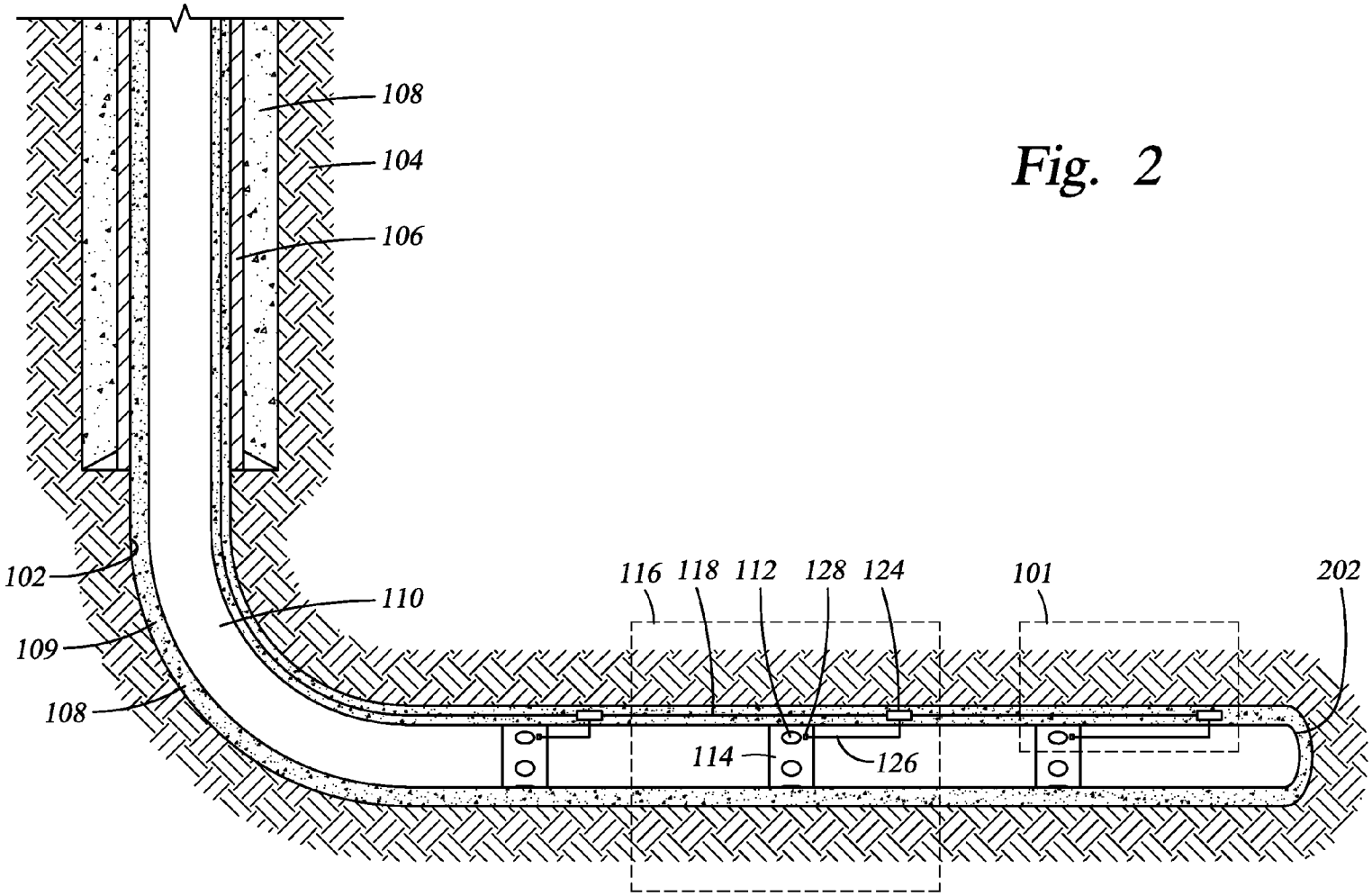
FIG. 2 shows the production tubing and sensing system strings of FIG. 1 with cement injected into an annulus formed between the production tubing and a wellbore.

FIG. 2 shows the production tubing 110 and sensing system 101 strings of FIG. 1 with cement 108 injected into the annulus 109. In one example, cement 108 is injected into the production tubing 110 and exits at a tube toe 202 to fill the annulus 109. In FIG. 2, cement is shown filling annulus 109 upwards of the intersection between the production tubing and the casing 106. However, it will be understood that a packer or similar device could isolate the annulus above the casing and the cement could terminate at a lower end of the casing.

Figure 3:
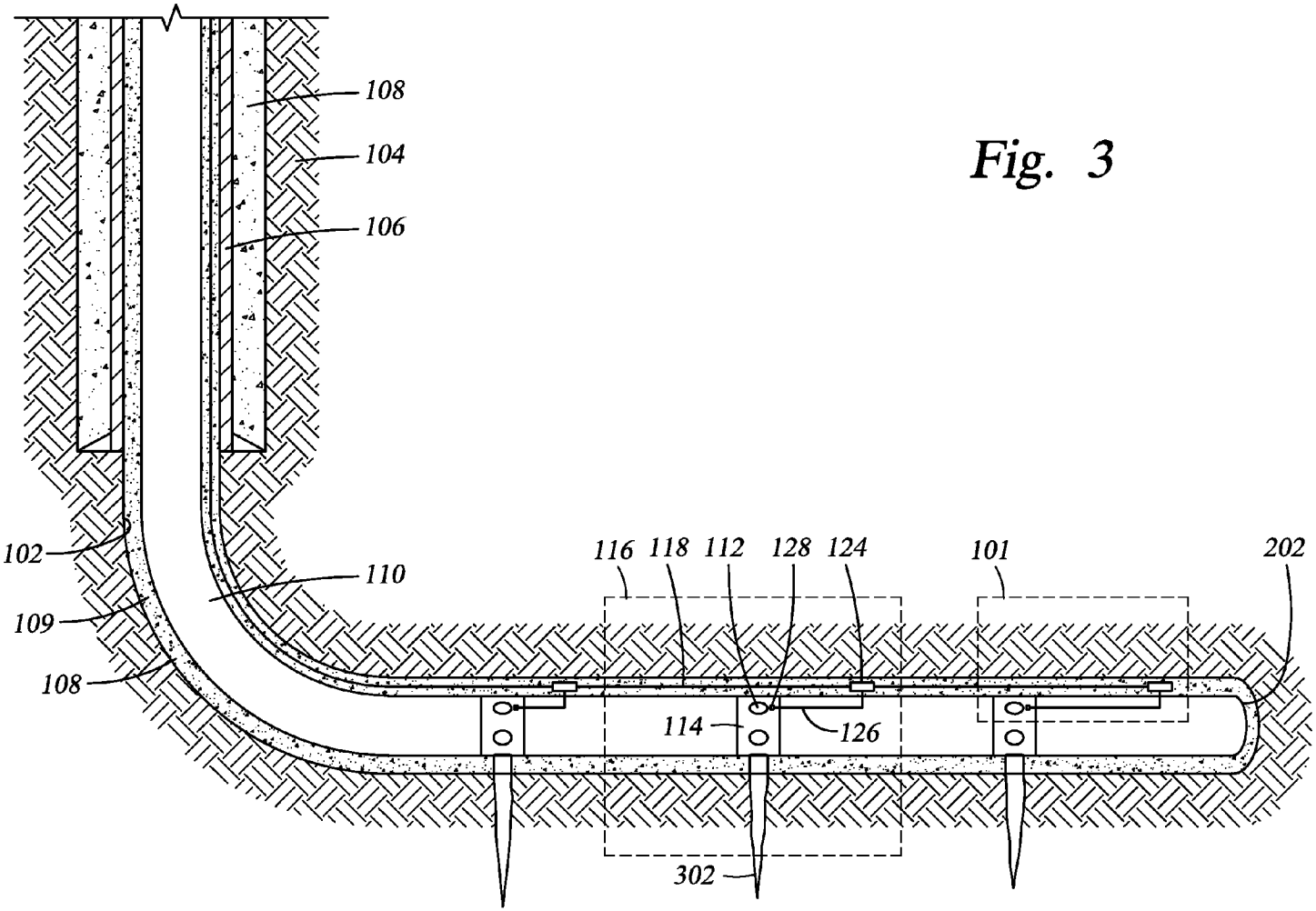
FIG. 3 shows the production tubing and sensor system strings of FIG. 2 after the cement has been perforated by a fracking fluid.

FIG. 3 shows the production tubing 110 and sensor system 101 strings of FIG. 2 after the cement 108 has been perforated by the fracking fluid. To inject fracking fluid into the formation 104, the fracking ports 112 of the fracking sleeve 114 are remotely opened. In one example, U.S. Pat. No. 8,245,788 discloses a ball used to actuate the fracking sleeve 114 and open the fracking port 112. The '788 patent is incorporated by reference herein in its entirety. The fracking fluid pressure creates perforations 302 in the cement 108 and fractures the adjacent formation 104. Production fluid travels through the fractures in the adjacent formation 104 and into the production tubing 110 at the fracking ports 112 via the perforations 302 in the cement 108. The injection of fracking fluid through the fracking port 112 may erode or dislodge the removable plug 128 on the communication path 126. The removable plug 128 may also be dislodged by the actuation of the fracking sleeve 114. The elimination of the removable plug 128 permits fluid to flow through the communication path 126 to the sensor 124 for an accurate reading of the fluid parameter at the fracking port 112. The measurements at each sensor 124 are carried through the sensing cable 118 to provide information about the fluid characteristics in each fracking zone 116.

Figure 4:
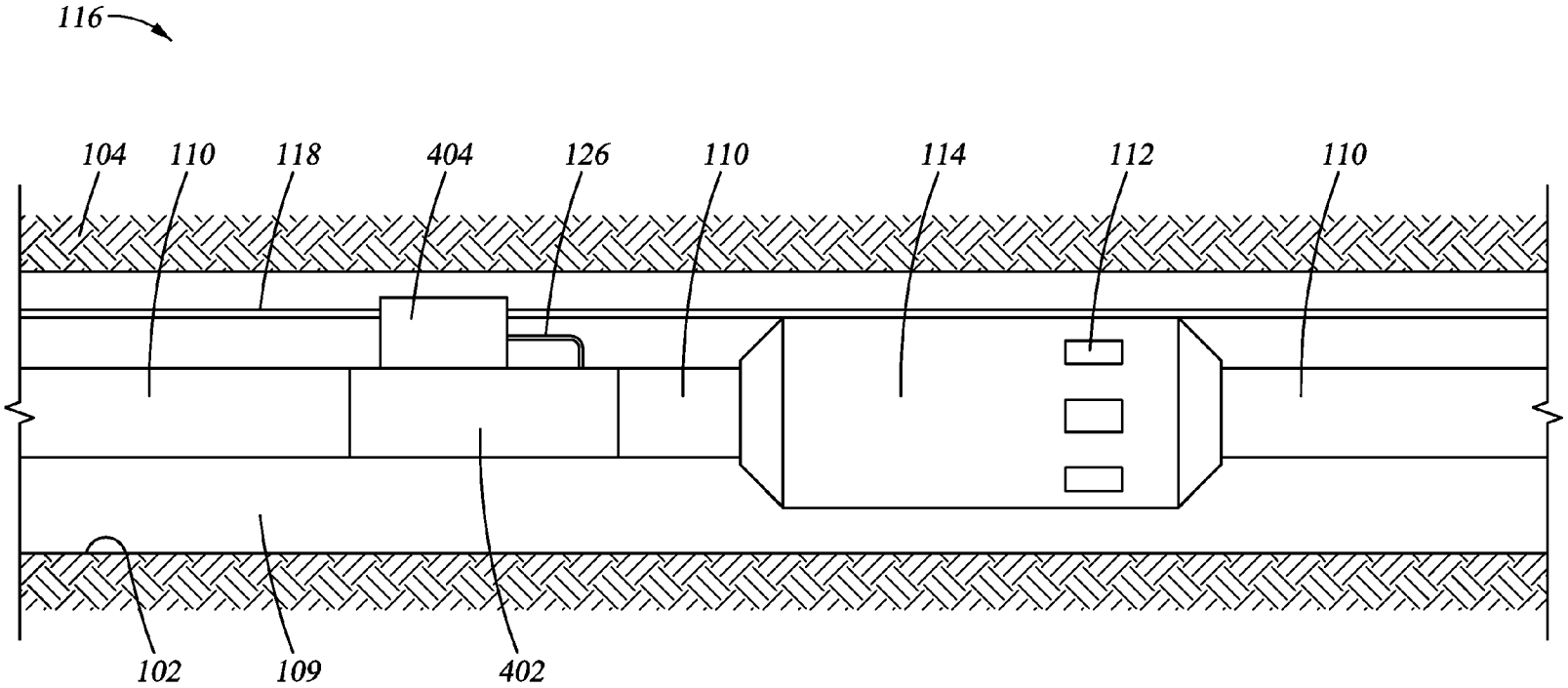
FIG. 4 shows the wellbore with a mandrel, the production tubing, and a fracking sleeve.

FIG. 4 shows the fracking zone 116 with a mandrel 402, the production tubing 110, and the fracking sleeve 114. The mandrel 402 includes a sensor container 404 and couples the sensing system 101 (FIG. 3) to the production tubing 110. In one example, the mandrel 402 may be installed on the production tubing 110 at a location of the sensor 124 (not visible) on the sensing cable 118. The sensor container 404 forms a seal around the sensor 124, prevents contact with cement 108 during the cementing operation, and ensures that fluid is transmitted to the sensor 124 during the fracking and production operations.

In another embodiment, the sensor container 404 is on a container carrier (not shown). The container carrier is coupled to the production tubing 110 and is independent of the mandrel 402. Therefore, the container carrier provides the ability to attach the sensor container 404 to the production tubing 110 at locations not adjacent the mandrel 402 or the fracking sleeve 114. The communication path 126 of sufficient length is provided to couple the sensor 124 to the mandrel 402.

Figure 5:
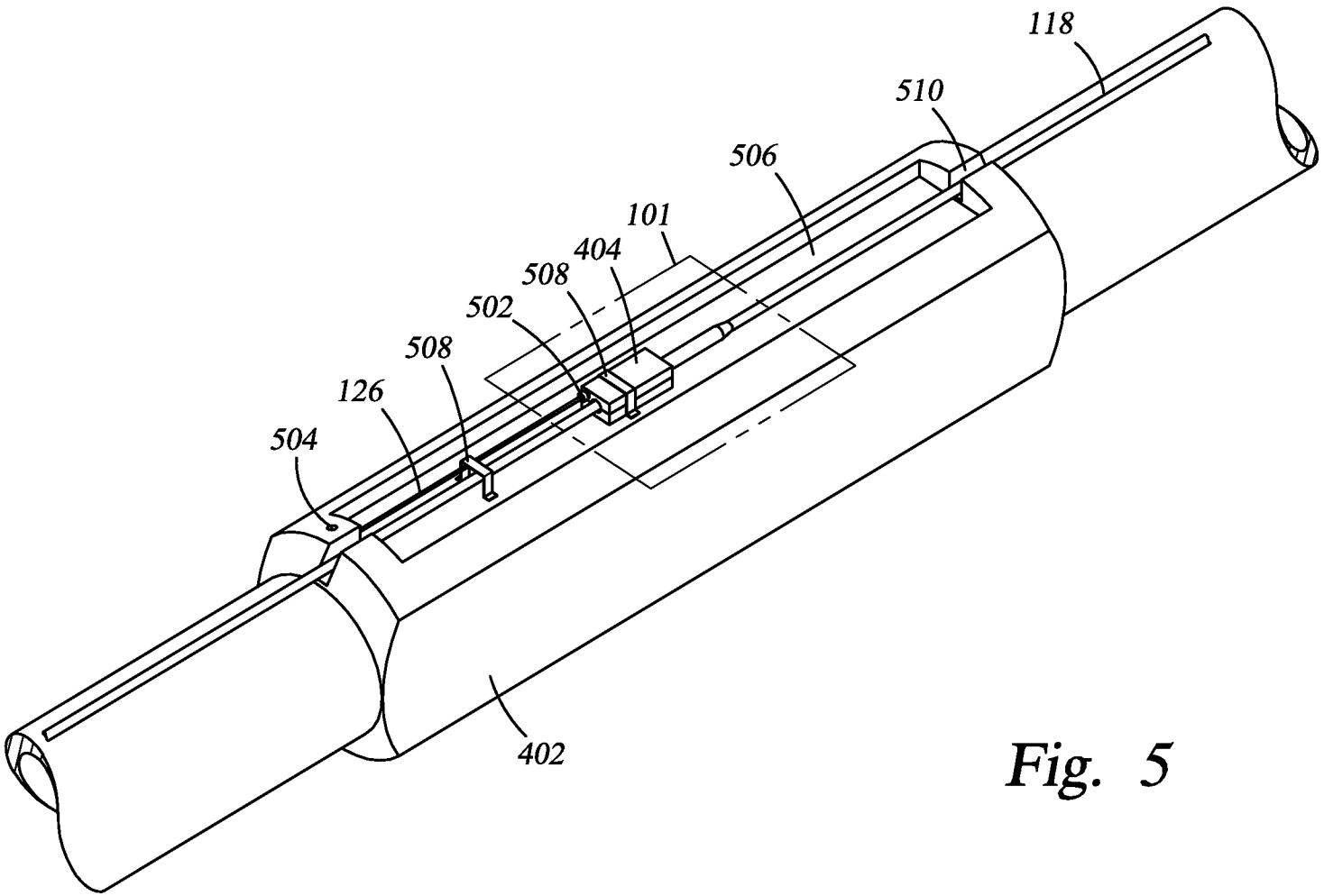
FIG. 5 shows a sensor container on the mandrel of FIG. 4.

FIG. 5 shows the sensor container 404 on the mandrel 402 of FIG. 4. The mandrel 402 protects the sensor container 404, the communication path 126, a sensor port 502, and a tube port 504 from contact with the walls of the wellbore 102.

In the embodiment shown, the mandrel 402 includes a holding area 506, which provides an enlarged area to seat the sensing system 101. The position of the sensor container 404 in the holding area 506 determines the minimum length of the communication path 126. In one example, the communication path 126 must be sufficient in length to couple the tube port 504 to the sensor port 502. The tube port 504 supplies fluid from the inner diameter of the mandrel 402 directly to the communication path 126. Fluid flows through the communication path 126 to the sensor port 502 on the sensor container 404.

The sensor container 404 is designed to easily attach to the holding area 506 on the mandrel 402. In one example, the sensor container 404 and/or the sensing cable 118 may be fastened to the mandrel 402 by a clamping mechanism 508. The clamping mechanism 508 restricts the sensor container 404 from shifting in the holding area 506. To further provide a secure fit in the holding area 506, a cable slot 510 may be machined into the mandrel 402 at each end of the holding area 506. The mandrel 402 may include a mandrel cover (not shown) to cover the holding area 506 and further secure the sensing system 101.

Figure 6:
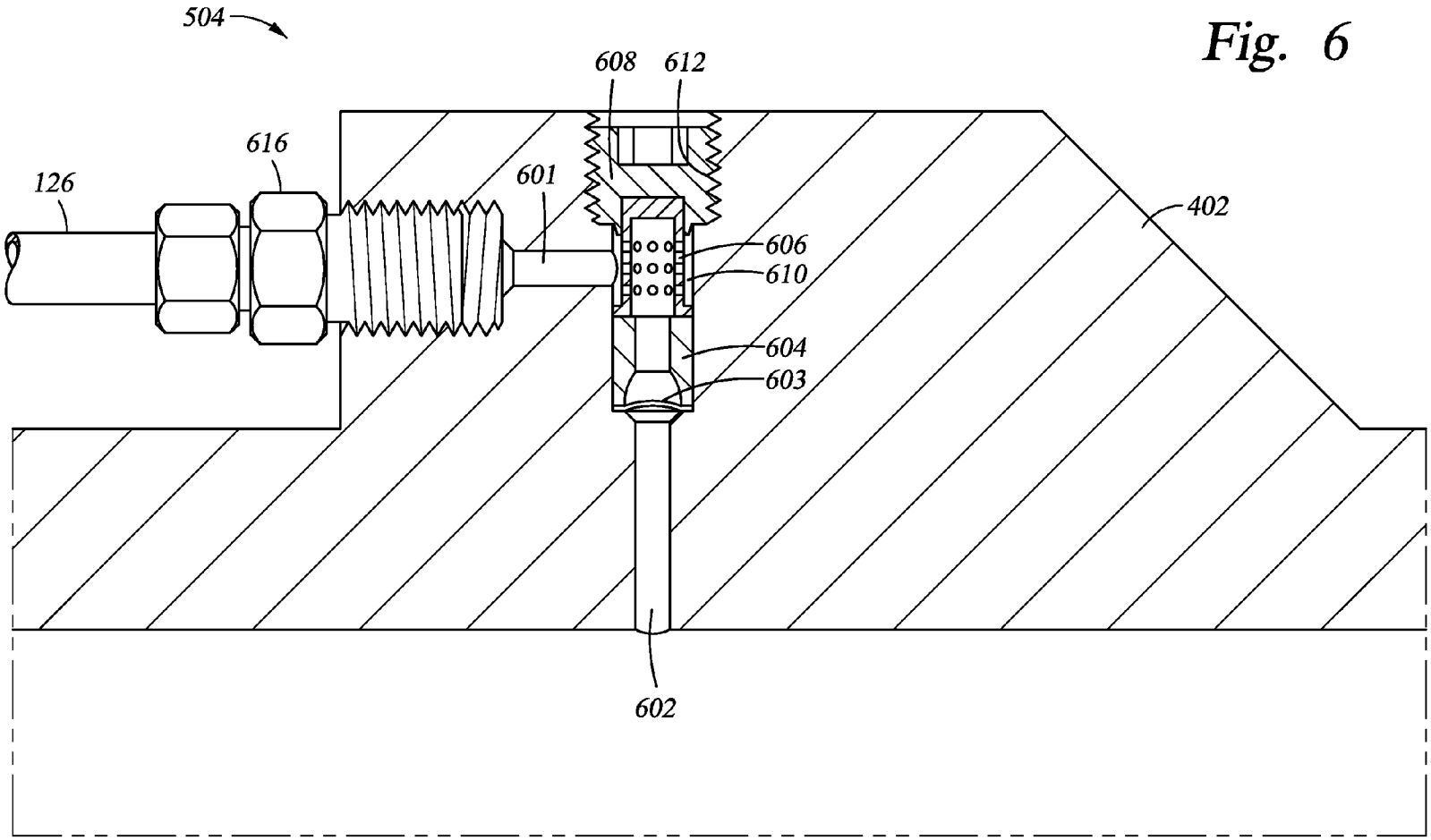
FIG. 6 shows a cross section of a tube port.

FIG. 6 shows a cross section of the tube port 504. The tube port 504 provides fluid communication between the communication path 126 and the mandrel 402 via a fluid channel 601 and a vertical drill hole 602. In one example, the tube port 504 includes a removable seal, a disc plug 604, a debris screen 606, and a plug fastener 608. The removable seal may be a burst disc 603.

The burst disc 603 is seated and sealed by the disc plug 604 in a tube slot 610. The burst disc 603 prevents cement 108 from entering the communication path 126 during the cementing operation. However, the burst disc 603 may fail and allow fluid to enter the communication path 126 during the fracking operation. In one example, the burst disc 603 may be manufactured of a material set to fail above the pressure used in the cement operation, but below the pressure used in the fracking operation. After the burst disc 603 fails, a sample of fluid in the mandrel 402 flows through the vertical drill hole 602 and into the tube slot 610. The debris screen 606, which is seated in the tube slot 610 on the disc plug 604, traps material from the burst disc 603 and prevents the communication path 126 from clogging. After the debris screen 606 filters the fluid, the fluid enters the communication path 126 by passing through the fluid channel 601 and a fitting 616. The burst disc 603, the disc plug 604, and the debris screen 606 are held in the tube slot 610 by the plug fastener 608, which sits in a plug slot 612.

In another embodiment, the tube port 504 includes the fluid channel 601 and the vertical drill hole 602 separated by a removable plug (not shown). The removable plug may be dislodged or eroded by fluid flowing through the mandrel 402. After the removable plug is eliminated, a sample of fluid in the mandrel 402 flows into the communication path 126 for a parameter reading in the sensing container 404.

Figure 7:
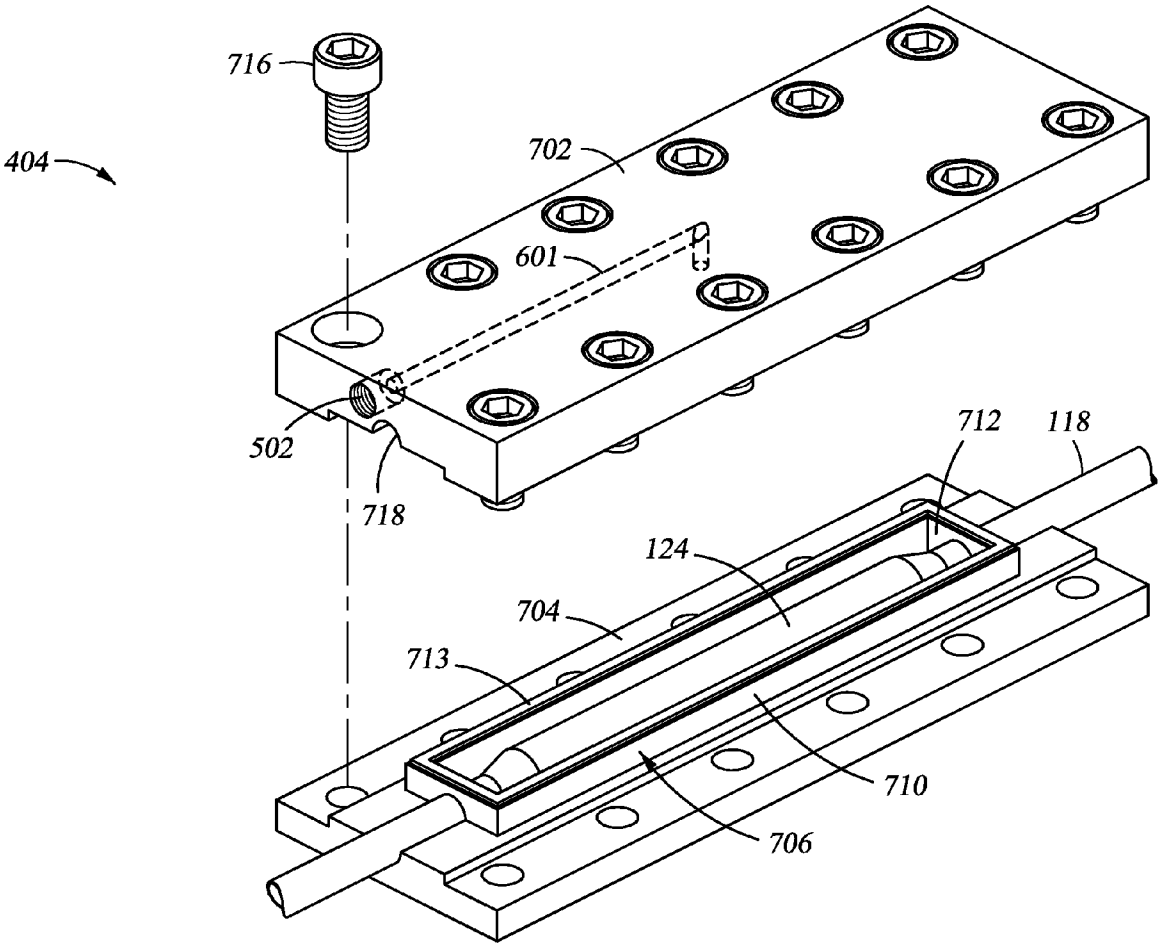
FIG. 7 shows the sensor container.

FIG. 7 shows the sensor container 404. The sensor container 404 includes a container cover 702 and a container base 704. In one example, at least one bolt 716 may be used to couple the container cover 702 to the container base 704. The container cover 702 and the container base 704 are machined to align and fit around the sensor 124 and the sensing cable 118. In one example, grooves 718 may be machined into the container cover 702 and the container base 704 to align the sensor 124 in a sensor compartment 706.

The sensor compartment 706 isolates the sensor 124 and ensures accurate sensor measurements by providing a seal. In one embodiment, the sensor compartment 706 may be located on the container base 704 and include a pair of side seals 710 and a pair of end seals 712. The side seals 710 run parallel to the sensing cable 118 and the end seals 712 run over and around the sensing cable 118. The side seals 710 and the end seals 712 may include a layer of seal material 713 that prevents fluid from contacting the sensor 124.

The sensor 124 determines the parameters of fluid in the production tubing 110. In one example, the sensor 124 reads a pressure of the fluid at varying stages of the drilling operation. The sensor 124 may measure the pressure of the fracking fluid injected into the formation 104 during the fracking operation. The sensor 124 may also measure the pressure of the production fluid exiting the formation 104 during the production operation. The sensor 124 may be either completely or partially covered by the sensor container 404.

The sensor container 404 includes the sensor port 502. The sensor port 502 couples the communication path 126 to the sensor compartment 706 by feeding fluid into the fluid channel 601. In one example, the container cover 702 includes the sensor port 502 and a test port (not shown) opposite the sensor port 502. The test port is substantially similar or identical to the sensor port 502 and tests the quality of the side and end seals 710, 712.

While the foregoing is directed to embodiments of the present invention, other and further embodiments of the invention may be devised without departing from the basic scope thereof, and the scope thereof is determined by the claims that follow.

The invention claimed is:

1. A method for determining a parameter of a production fluid in a wellbore, comprising:

attaching a plurality of sensors to a string of tubing equipped with a plurality of sleeves;

providing an isolated communication path for fluid communication between at least one of the plurality of sensors and at least one of a plurality of apertures formed in the sleeves, the apertures initially closed and the isolated communication path initially blocked, wherein the isolated communication path is initially blocked by a removable seal positioned between a bore of the string of tubing and the plurality of sensors to initially block fluid communication therebetween;

inserting the string of tubing into the wellbore;

cementing the string of tubing in the wellbore;

remotely opening the apertures in the sleeves;

injecting a fracking fluid into a formation adjacent the wellbore via the apertures, thereby perforating the cement;

unblocking the isolated communication path; and measuring the parameter of the production fluid adjacent the apertures.

2. The method of claim 1, further comprising measuring a parameter of the fracking fluid.

3. The method of claim 1, wherein the fracking fluid injected into the formation causes the unblocking of the isolated communication path.

4. The method of claim 1, wherein remotely opening the apertures causes the unblocking of the isolated communication path.

5. The method of claim 1, wherein measuring the parameter of the production fluid adjacent the apertures includes measuring the production fluid from an inner diameter of a mandrel coupled to the string of tubing.

6. The method of claim 1, wherein at least one of the sensors is attached to a mandrel.

7. The method of claim 1, wherein at least one of the sensors is attached to a carrier.

8. The method of claim 1, wherein the plurality of sensors are coupled to a sensing cable positioned along an outer diameter of the string of tubing.

9. The method of claim 1, wherein unblocking the isolated communication path comprises dislodging the removable seal from the isolated communication path in response to injecting the fracking fluid.

10. The method of claim 1, wherein unblocking the isolated communication path comprises dislodging the removable plug from the communication path in response to remotely opening the apertures in the sleeve.

11. A tool string for determining a parameter of a production fluid in a wellbore, comprising:

a tubing equipped with a sleeve, wherein at least one aperture is formed in the sleeve;

a sensor on a sensing cable, wherein the sensor is spaced from the at least one aperture;

a sensor container, wherein the sensor is at least partially enclosed in the sensor container; and an isolated communication path that spans a predetermined distance from the sensor container to the nearest at least one aperture, wherein the isolated communication path includes a removable seal positioned between a bore of the tubing and the sensor to initially block fluid communication therebetween.

12. The tool string of claim 11, wherein the sensor includes a fiber optic sensor.

13. The tool string of claim 11, wherein the sensor container is on a mandrel.

14. The tool string of claim 13, wherein the isolated communication path spans a predetermined distance from the sensor container to a port on the mandrel.

15. The tool string of claim 14, wherein the port includes the removable seal.

16. The tool string of claim 11, wherein the sensor container is on a carrier.

17. The tool string of claim 16, wherein the isolated communication path spans a predetermined distance from the sensor container to a port on a mandrel.

18. The tool string of claim 17, wherein the port includes the removable seal.

19. A container for determining a parameter of a production fluid in a wellbore, comprising:

a container cover and a container base;

a port on the container;

at least one fluid channel creating fluid communication between the port and a compartment in the container, the at least one fluid channel formed in the container cover;

an isolated communication path coupled to the port, wherein the isolated communication path is blocked;

a sensor at least partially enclosed by the container cover and the container base, wherein the sensor is isolated from external fluids; and a groove formed in the container cover or the container base to accommodate a sensor cable therethrough for connection to the sensor.

20. The container of claim 19, wherein the port is located on the container cover.

21. The container of claim 19, further including a test port.

22. The container of claim 19, wherein the compartment is sealed by a seal material.

23. The container of claim 19, further comprising a second groove formed in the container cover or the container base to accommodate egress of the sensor cable from the container.

24. The container of claim 19, wherein the container cover is fixedly attached to the container base.

25. The container of claim 24, wherein the container cover is fixedly attached to the container base by bolts, and wherein the groove to accommodate the sensor cable is formed at an interface of the container cover and the container base.

26. The container of claim 19, further comprising one or more seals at an interface of the container cover and the container base.

27. The container of claim 26, wherein the one or more seals are disposed around the sensing cable.

* * * * *